US007131375B2

(12) United States Patent
Byers et al.

(10) Patent No.: US 7,131,375 B2
(45) **Date of Patent: *Nov. 7, 2006**

(54) OFFSET LITHOGRAPHIC PRINTING PRESS HAVING SEAMED SLEEVED PRINTING BLANKET

(75) Inventors: Joseph L. Byers, Inman, SC (US); Leslie Scott Hix, Covington, GA (US); Timothy F. Badowski, Chicago, IL (US); Michael F. Stock, Johnsburg, IL (US)

(73) Assignee: MLP U.S.A., Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/186,997

(22) Filed: Jul. 20, 2005

(65) Prior Publication Data

US 2005/0252397 A1 Nov. 17, 2005

Related U.S. Application Data

(63) Continuation of application No. 11/014,321, filed on Dec. 16, 2004, now Pat. No. 6,981,444, which is a continuation of application No. 10/110,356, filed as application No. PCT/US00/28379 on Aug. 5, 2002, now Pat. No. 6,848,364, which is a continuation-in-part of application No. 09/419,493, filed on Oct. 15, 1999, now abandoned.

(51) Int. Cl.
*B41F 13/08* (2006.01)

(52) U.S. Cl. ..... 101/217; 101/216; 101/376; 101/401.1; 101/492; 428/909

(58) Field of Classification Search ..... None
See application file for complete search history.

(56) References Cited

U.S. PATENT DOCUMENTS

| | | | | |
|---|---|---|---|---|
| 5,323,702 | A | 6/1994 | Vrotacoe et al. | |
| 5,351,615 | A | 10/1994 | Kobler et al. | |
| 5,429,048 | A | 7/1995 | Gaffney et al. | |
| 5,440,981 | A | 8/1995 | Vrotacoe et al. | |
| 5,492,059 | A | 2/1996 | Reichel | |
| 5,522,315 | A | 6/1996 | Behnke et al. | |
| 5,535,674 | A | 7/1996 | Vrotacoe et al. | |
| 5,553,541 | A | 9/1996 | Vrotacoe et al. | |
| 5,654,100 | A | 8/1997 | Kobler et al. | |
| 5,749,298 | A | 5/1998 | Castelli et al. | |
| 6,484,632 | B1 | 11/2002 | Hoffmann et al. | |
| 6,769,362 | B1 * | 8/2004 | Okubo et al. | 101/375 |
| 6,782,820 | B1 | 8/2004 | Okubo et al. | |
| 2002/0002921 | A1 * | 1/2002 | Hoffmann et al. | 101/376 |
| 2002/0134264 | A1 | 9/2002 | Okubo et al. | |
| 2004/0031407 | A1 | 2/2004 | Invernizzi | |

* cited by examiner

*Primary Examiner*—Andrew H. Hirshfeld
*Assistant Examiner*—Jill E. Culler
(74) *Attorney, Agent, or Firm*—William P. Oberhardt

(57) ABSTRACT

An offset lithographic printing press combined with a gapped or seamed cylindrical offset printing blanket having pre-made blanket material mounted on a cylindrical sleeve is disclosed, wherein conventional, manufactured blanket material in flat form is adhered to a cylindrical sleeve to economically produce a cylindrical sleeved blanket. The leading and trailing ends of the flat blanket material are joined in close proximity such that a small gap is formed. A seam may be made with a filler material that fills the remaining gap resulting in a seamed sleeved blanket. In use, the seam is aligned with the non-print area on the adjacent printing plate, or the adjacent plate cylinder gap of the printing press. Being narrower than the plate cylinder gap, no loss of print length results from the seam.

20 Claims, 7 Drawing Sheets

OFFSET LITHOGRAPHIC PRINTING PRESS HAVING SEAMED SLEEVED PRINTING BLANKET

This application is a continuation of a U.S. application Ser. No. 11/014,321, filed Dec. 16, 2004 now U.S. Pat. No. 6,981,444, which, in turn, is a continuation of U.S. application Ser. No. 10/110,356, filed Aug. 5, 2002, now U.S. Pat. No. 6,848,364 patented Feb. 1, 2005, which, in turn, is a section 371 of international application No. PCT/US00/28379, filed Oct. 13, 2000, which, in turn, is a continuation-in-part of U.S. application Ser. No. 09/419,493, filed Oct. 15, 1999, now abandoned.

BACKGROUND OF THE INVENTION

Prior art seamless cylindrical or sleeved offset printing blanket technology is well known in the industry and documented in several patents, for example, those assigned to Heidelberg Harris (U.S. Pat. Nos. 5,323,702; 5,429,048; 5,440,981; 5,553,541; 5,553,674 and U.S. Pat. No. 5,654,100) and to Reeves Brothers Inc. (Pat. No. 5,522,315) the contents of all of which patents are hereby incorporated by reference. Two examples of the prior art seamless sleeved blankets 10A, 10B are illustrated in the schematic drawings of FIGS. 1 to 3. FIGS. 2 and 3 are taken in sections parallel to the circular end of the roll. For ease of illustration, the curvature of the roll has not been shown. The FIG. 2 version 10A contains two windings of spiral wound thread 12A and is typical of blankets produced by Reeves and Day (for the Heidelberg presses). The 10A version also has a sleeve 14A, usually of nickel, the spiral wrapped threads 12A, a compressible layer 16A made of typically a rubber containing microspheres, a reinforcing layer 18A carrying another roll of spiral wrapped threads 12A, made of rubber with threads being cotton, polyester or other materials, and the printing layer 20A having a printing face 22A. Of course, the blanket including its sleeve actually curve around forming a continuous cylinder. FIG. 3 showing the version 10B, contains only one winding of spiral thread 12A and includes a thick rubber base layer 14B. This construction is typical of Sumitomo produced sleeves for use on Mitsubishi presses. This seamless cylindrical sleeve has the inner nickel sleeve 16B, a compressible layer 18B which can be joined to the base 14B by an adhesive layer 20B. A printing layer 22B is provided and has a printing face 24B. Again, the sleeve 10B actually curves around to form a seamless cylinder as shown in FIG. 1.

In the prior art, cylindrical offset sleeved printing blankets, such as discussed above, are produced by spiral winding carrier and reinforcing threads 12A/12B helically around a continuous sleeve 24A/16B. The sleeve is usually coated with an adhesion promoting primer. A first layer of polymeric coated thread is spiral wound onto the coated sleeve by passing the thread through a dip tank containing the solvated and uncured polymeric material as it is spiraled around the rotating sleeve. Dispersed in the polymeric material of this first layer are hollow microspheres that provide compressibility to the finished blanket. The amount of the coating is typically controlled as the thread exits the dip tank through a restrictive opening which must be large enough to allow the microspheres to pass through while small enough to prevent excessive coating and the resulting inability to dry and set the polymeric material before sagging can occur. The coating is relatively thick such the solvents must be evaporated very slowly prior to curing to prevent trapped gasses from blowing unwanted voids in the finished layer. The long evaporation time tends to slow down the production rate. The polymeric material is then cured. The resulting compressible layer is very rough, uneven and overbuilt, requiring grinding to the required dimensions.

The polymeric material applied by this method tends to maintain its form around the diameter of the thread resulting in unfilled valleys between this layer and the coated sleeve. This unfilled area leads to gauge loss (thickness or diameter loss of a finished blanket sleeve—which can result in loss of printing contact) in the finished product and is sometimes compensated for by carrying out the additional steps by spreading a filling layer of solvated polymeric material onto the coated sleeve with a doctor blade set up prior to winding of the coated threads. Of course, all of the polymeric material may be applied with a doctor blade set up, as a calendered sheet or other methods known to the art and the threads omitted or spiraled around or under the applied polymeric layer.

After grinding the first inner layer to the required dimensions, a second outer layer of polymeric coated thread is wound around the sleeve in a similar fashion to the first layer, however, microspheres are not included. This layer serves as a reinforcing layer and stabilizes the overformed printing surface. Again, the polymeric material may also be applied with a doctor blade set up, as a calendered sheet or other method known to the art and the threads omitted or spiraled around or under the thus applied polymeric layer.

The overlaid printing surface may be applied as a solvated polymeric compound utilizing a doctor blade set up or as a solid by several methods known to the art such as any known extrusion or calendering process. The completed composite is cross wrapped or otherwise held in place, then cured with pressure applied to the outer layer by several methods known to the art to mold and adhere all layers together. In the final step the cured composite is again ground to the required dimensions in such a way as to provide a surface profile conducive to ink transfer.

This process results in a cylindrical offset printing blanket that is completely seamless throughout all of its layers but requires every step to be carefully performed on an individual, sleeve by sleeve basis. Efficiencies associated with mass batching of component parts are very limited, if not impossible. It has also been found that cylindrical offset printing blankets produced by this method tend to draw in the width, wrinkle or crease the paper web during use resulting in unacceptable side to side registration through successive printing units. In the prior art, to overcome this deficiency the compressible layer is profiled in a convex manner during the grinding operation to provide a spring effect on the paper web, further requiring the individual processing of each sleeve during this step in the manufacturing process.

SUMMARY OF THE INVENTION

This invention utilizes a pre-made or pre-manufactured, unitary flat offset printing blanket made by any of the methods known to the art of flat offset printing blanket manufacturing to produce, in mass, a unitized composite blanket covering which can be applied, in a seamless fashion, to a continuous supporting sleeve, such that the seam has a negligible effect on print length and gap bounce. The pre-made blanket material will contain requisite reinforcements which are generally layed out in a rectangular manner, and are not spiral wound. The seam is preferably parallel to the longitudinal axis of the sleeve and not skewed ideally by more than 1/16" of inch for a plate of 1/16" of inch plate gap to avoid registration and print length issues. For other size plate gaps one could use other tolerance but preferably not larger than the plate gap. The opposing ends of the flat blanket should butt together as closely as possible but preferably leave some gap to provide a good fit should cut blanket lengths vary, and the resulting gap should preferably be narrower than the plate gap of the press for which the sleeve is designed if it is to be aligned in that manner. In this way, the two gaps (one in the blanket—the other on the press plate cylinder) can be aligned during use so that there is no loss of print area or it is limited to the plate gap area. Alternatively, the seam can be made to coincide with any non-utilized area of a plate cylinder, such as, for example, in the trim margins of adjacent print areas.

The invention may include a blanket index, location or locking system or the like, which could use a pin and opening or other mechanism and insures that the blanket and plate gap (or other chosen area) always match perfectly. Preferably, the gap between the opposing ends of the blanket can be filled with a resilient and solvent resistant compound to minimize gap bounce and especially to prevent water and solvents from wicking into the ends of the blanket. If this wicking is not prevented, swelling and delamination would be expected to occur.

In use, installation time is maintained at a minimum by providing a blanket in cylindrical or sleeve form when installed on the press's blanket cylinder. By utilizing flat blanket technology, there is no need for special profiling to spread the paper web. The unitized composite blanket covering may also be purchased as a standard material available from any number of offset printing blanket manufacturers and applied to a continuous supporting sleeve according to the method of this invention.

The sleeve could be made of metallic, for example, nickel or steel, or non-metallic construction, say a solid, laminate or winding of films, such as mylar or thermoplastics. The use of a non-metallic sleeve is possible as there is no need to vulcanize or subject the product to high heat to cure during manufacture.

OBJECTS OF THE PRESENT INVENTION

It is the object of this invention to provide a seamed offset printing blanket that maintains the benefits of the prior art (maximized print length, minimized gap bounce and reduced installation time) while reducing manufacturing time and expense.

It is an object of the present invention to provide a seamed sleeved blanket for a printing press.

It is another object of the present invention to provide a method for making a seamed sleeved blanket for a printing press.

It is yet another object of the present invention is to provide a method for using the seamed sleeved blanket of the present invention.

A still further object of the present invention is to provide a seamed sleeved blanket in combination with a printing press.

Yet a further object of the present invention is to provide a combination of seamed sleeved blanket, printing press and indexing, locating or locking system.

Another object is to provide a seamed sleeved blanket which can utilize a non-metallic sleeve.

These and other objects of the present invention will become apparent from the following specification and accompanying drawings.

DESCRIPTION OF THE PREFERRED EMBODIMENT

Figure 1:
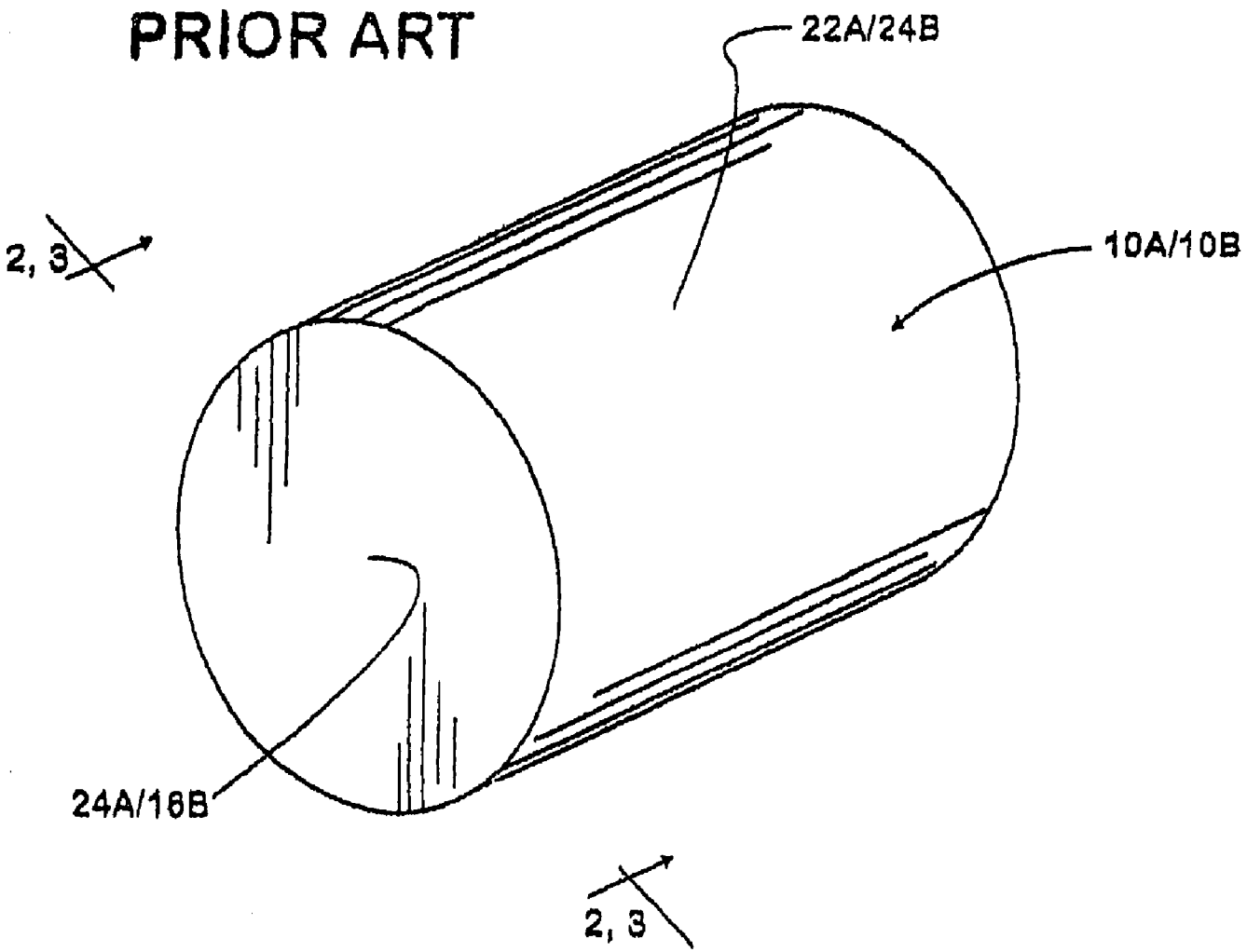
FIG. 1 PRIOR ART
FIG. 1 is a schematic view of a prior art seamless blanket showing where the section shown in FIGS. 2 and 3 are taken along the lines 2/3—2/3 (the slash meaning "or").
Figure 2:
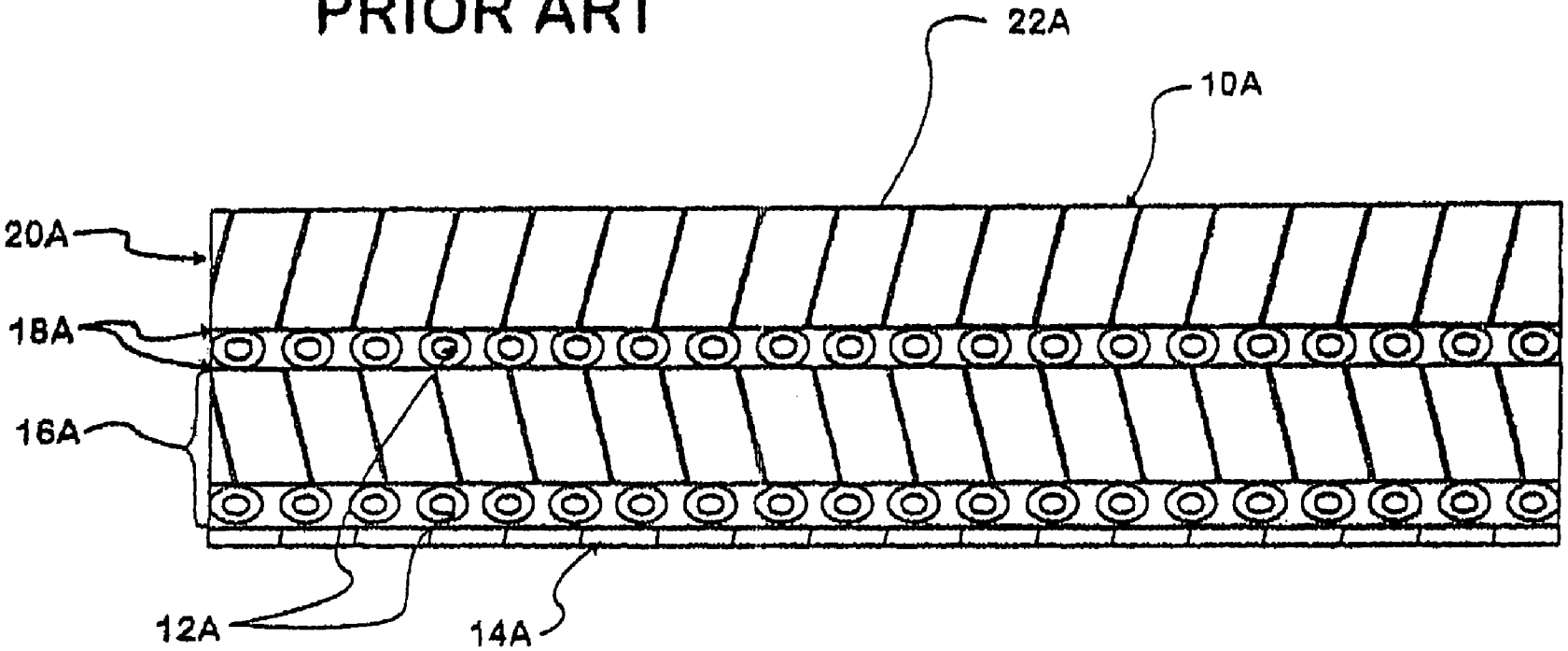
FIG. 2 PRIOR ART
FIG. 2 is a cross-sectional view of a segment of a prior art seamless sleeved blanket with the actual curvature being omitted for simplicity.
Figure 3:
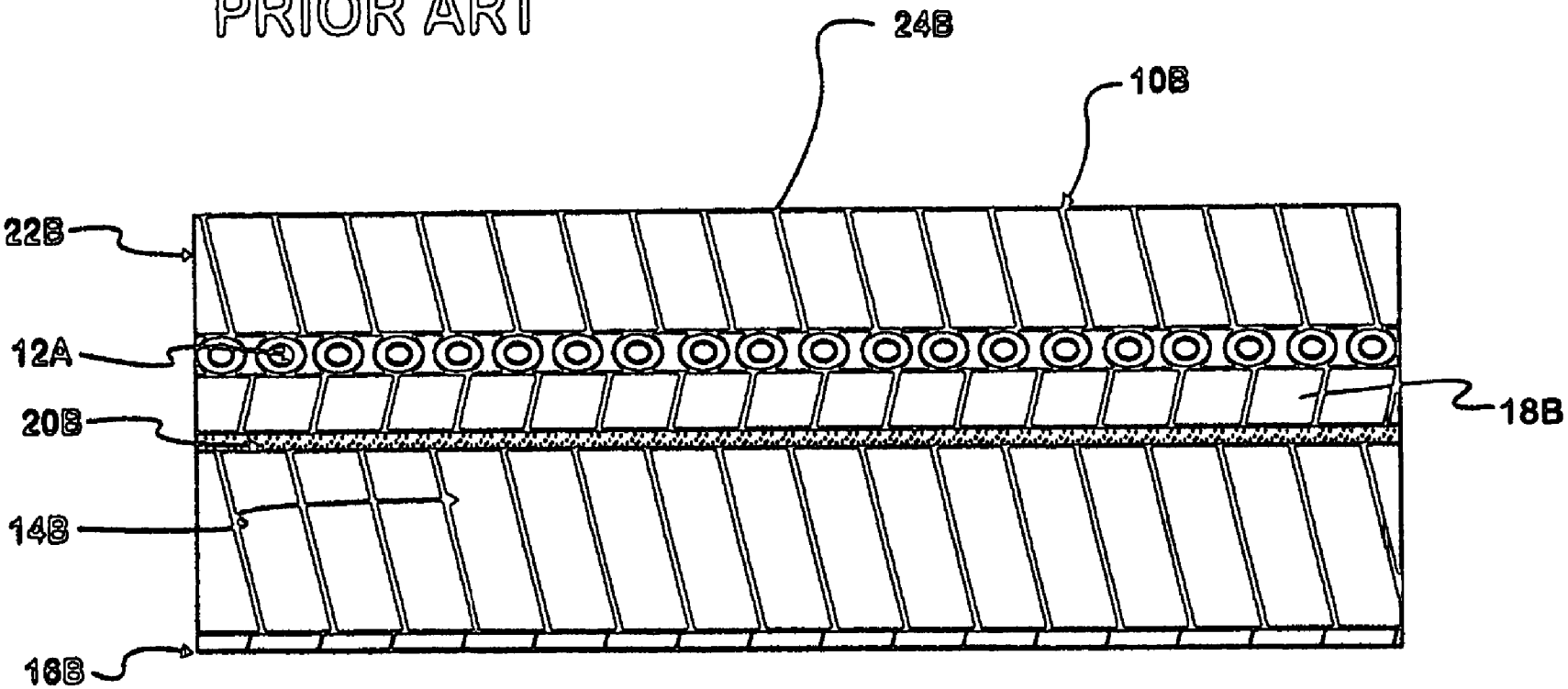
FIG. 3 PRIOR ART
FIG. 3 is a cross-sectional view of a segment of a second prior art seamless sleeved blanket with the curvature being omitted for simplicity.
Figure 4:
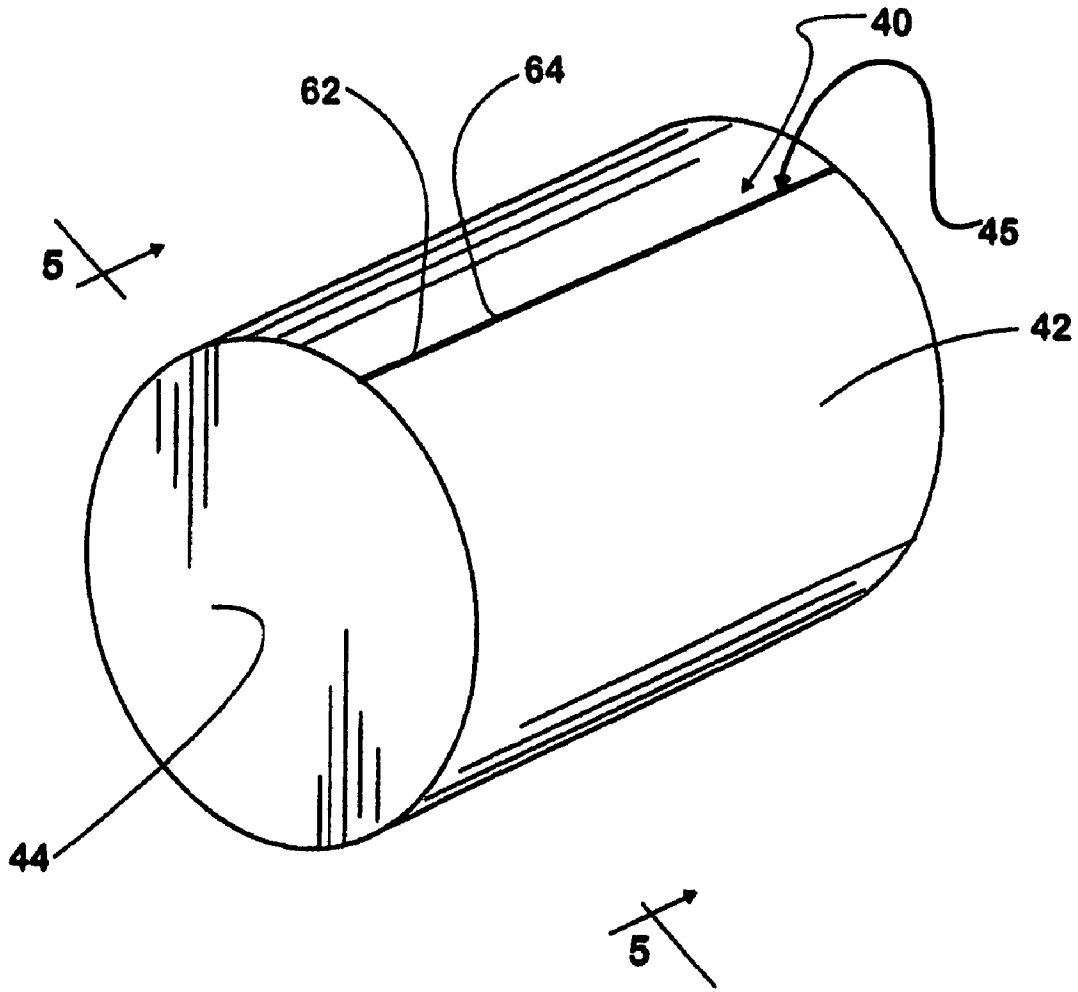
FIG. 4 is a schematic view of the seamed blanket of the present invention showing where the section shown in FIG. 5 is taken along the lines 5—5.
Figure 5:
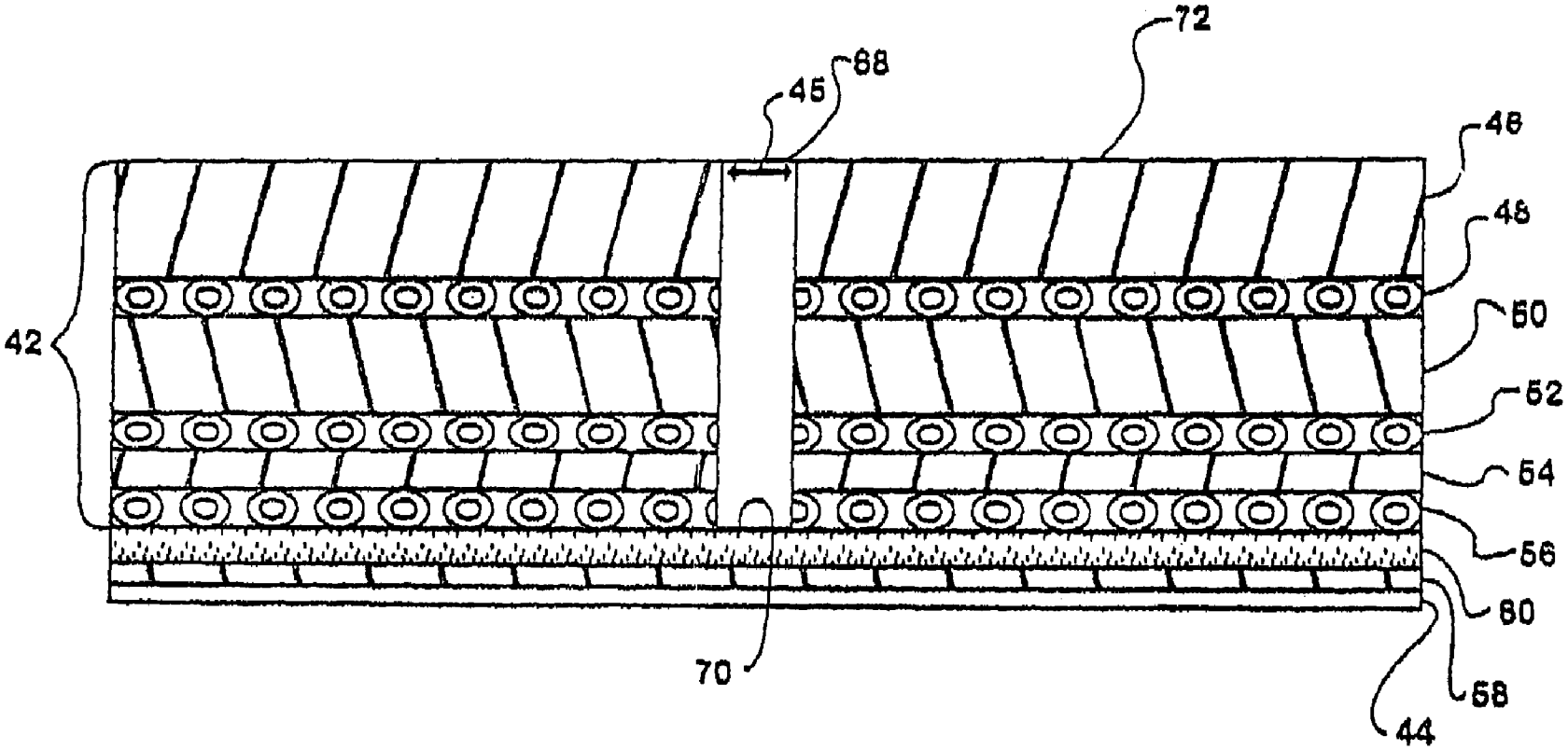
FIG. 5 is a cross-sectional view of a segment of an embodiment of seamed blanket of the present invention with the curvature being omitted for simplicity.
Figure 6:
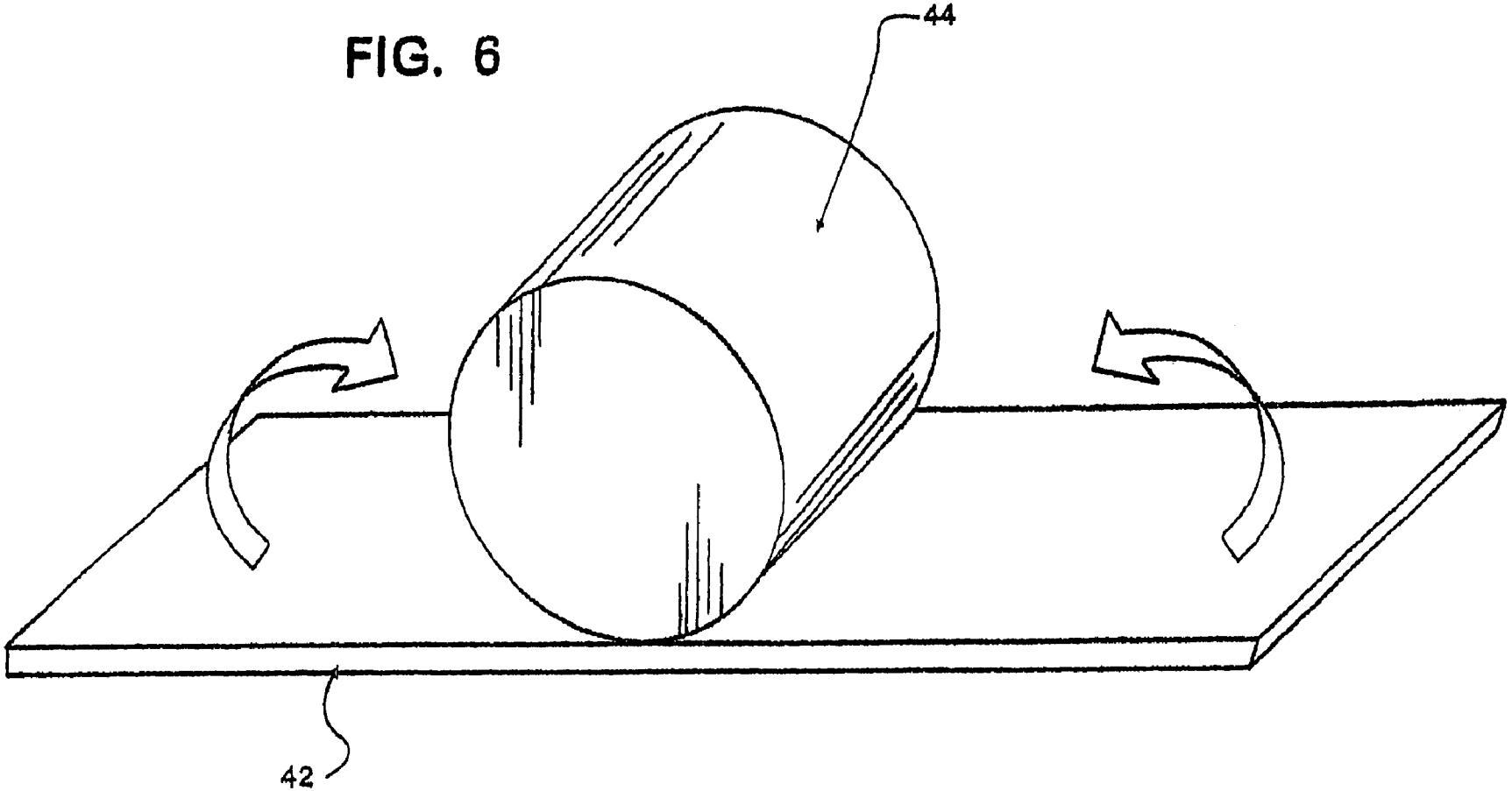
FIG. 6 is a schematic view indicating how a sheet of the pre-manufactured blanket material is wrapped around the sleeve to make the seamed sleeved blanket of the present invention.
Figure 7:
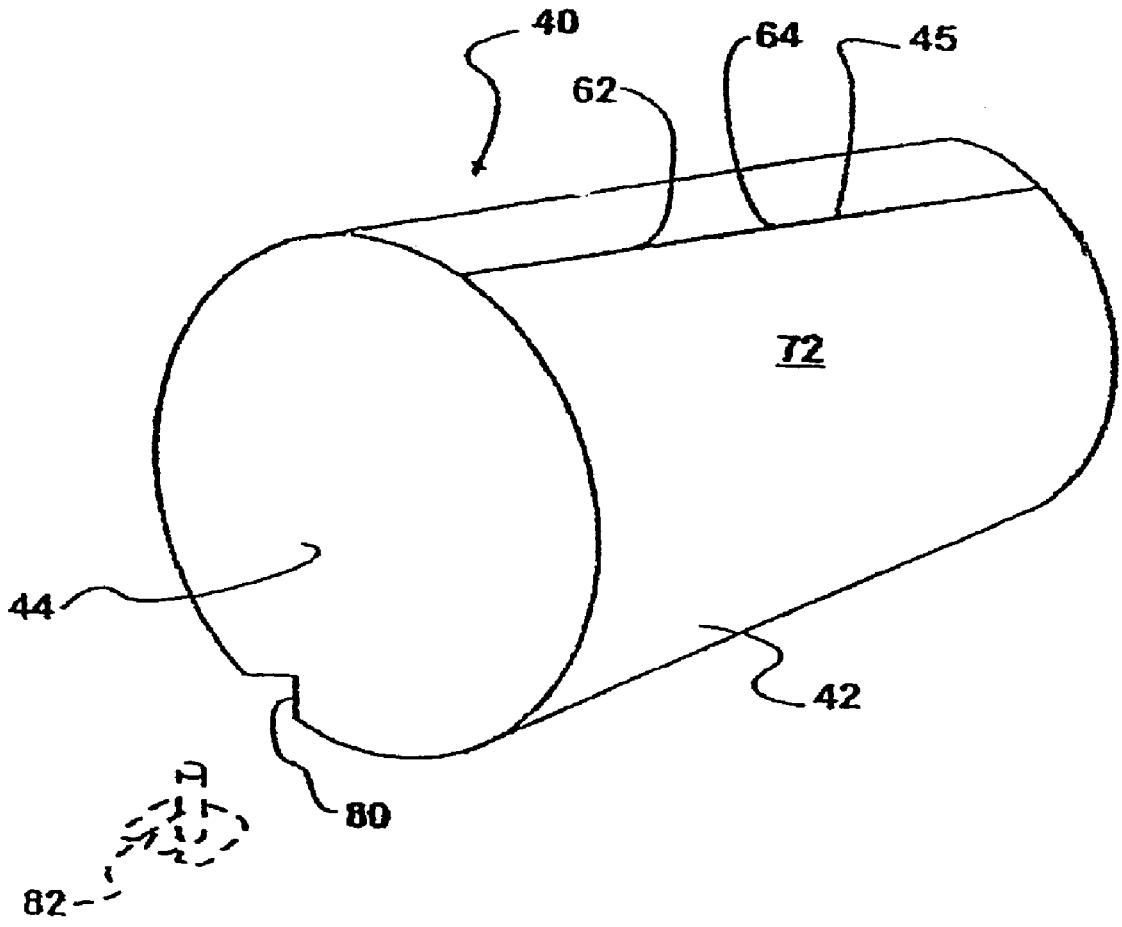
FIG. 7 is a perspective view of the sleeve of the present invention showing how it may be notched to index or lock it into place with respect to a press's blanket cylinder.

A schematic drawing of the seamed sleeved blanket 40 produced according to this invention can be seen in FIGS. 4 through 7. As shown in FIG. 6, according to this invention a conventional flat offset printing blanket material 42 may be manufactured by methods well known to the art or purchased in roll form and cut to specific dimensions so that it can be wrapped (as indicated by the large arrows) as a solid sheet around a continuous supporting sleeve 44 to produce the seamed sleeved blanket 40 of the present invention and shown in FIG. 4, the gap or seam being given numeral 45. Referring to FIG. 5, preferably the following construction method can be used. The blanket material 42 could be of any desired coaxially available structure and could have a rubber surface 46, say 0.023 inches thick over a first outer fabric layer 48 (reinforcement), say 0.009 inches thick, over a compressible layer 50, say 0.014 inches thick, over a middle fabric layer 52 (reinforcement), say 0.011 inches thick, over an adhesive layer 54, say 0.0002 inches thick, over an inner fabric layer 56 (reinforcement), say 0.015 inches thick. The sleeve be metallic or non-metallic, and if metallic, preferably of nickel. The expandable nickel sleeve has been the sleeve of choice for sleeve offset blankets. There are alternative materials that can be used such as fiberglass, kevlar, plastic, and/or a polyethylene (PET) sleeve. Some of these materials and particularly PET have several advantages over the nickel: lower cost, safer for the operator (no sharp edges), more durable than nickel in the manufacturing and pressroom environment. While the reinforcement shown was fabric, other conventional reinforcements could also be used. The sleeve 44 would be treated with a primer 58, say 0.002 inches thick, and covered with a urethane or other adhesive 60, say 0.002 inches thick, that bonds or adheres the blanket material 42 to the sleeve 44. The across the roll dimension may be cut equal to or less than the length of the sleeve 44 and the around or circumferencial dimension may be cut equal to or no more than 1/16" less than the outer surface length or circumference of the sleeve for use on a press with a plate gap of 1/16 of an inch. Of course, for other size plate gaps, this dimension could vary. The ends 62 and 64 (of FIG. 4) of the flat blanket material 42 may also be cut or skived at an angle so that the ends meet in the seam 45 (indicated by the heavy double arrow in FIG. 5) generally flush from top 68 (outer surface) to bottom 70 (inner surface) (see FIG. 5) when wrapped around the sleeve 44. The roll goods from which the cuts are made may be of any length and width common in the industry but should be maximized to provide the greatest number of cuts possible without excessive cutting waste. Manufacturing or purchasing in this form takes advantage of the efficiencies associated with mass production. It is well known that the wider and longer a roll of printing blanket material is produced, the less the cost per unit area.

The requirements of the flat offset printing blanket material 42 are the same as for any offset printing blanket and may vary according to the specific end use. A typical blanket physicals are: compressible layer 0.008 to 0.014 thick, stretch less the 1.25%, ply adhesion>2 lbs/linear inch, tensile stretch>300 pounds/linear inch, Shore A Durometer 70–85. Additionally, the printing face 72 usually will be overbuilt for grinding of the finished product to the required dimensions. The preferred printing blanket construction according to this invention is one containing one or more, but preferably, three plies 48, 52 and 56 of reinforcing fabric bonded together with an adhesive or solvent polymeric resistant cement, preferably a nitrile cement is used. Alternatively, nonwovens, films or other supporting substrate, could be used instead of fabric. As the blanket material was premanufactured, the reinforcement generally will not be spiral wound but will run parallel and perpendicular at right angles to the center axis of the blanket cylinder axis and/or the axis of the blanket sleeve when installed on the blanket cylinder. It is believed that the absence of non-spiral windings in the present invention is beneficial to printing, keeping registration and avoiding web draw in. The blanket material should preferably contain a compressible or foam layer 50 between the two upper fabric plies 48 and 52 that is uniform in thickness across the width. This carcass construction should be in a range of 0.025 to 0.070, and preferably, approximately 0.055 inches in thickness. Of course other thickness could be used. A solvent resistant polymeric printing face 46 preferably made of nitrile or nitrile blends with other polymers is applied over the top ply of fabric and should be in a range of 0.010 to 0.070 and preferably no less than 0.044 inches thick so that the total gauge of the finished flat blanket is in a range of 0.030 to 0.110 and preferably approximately 0.096 inches thick.

After the individual pieces of blanket material 42 are cut to the appropriate size to fit around the sleeve, they are dried in an oven, for about 30 minutes at, for example, 150° F. to remove moisture or otherwise treated to remove moisture. Note, the blankets' sleeve is not subject to this drying, making the use of many non-metallic sleeve materials possible. The dried or moisture free blanket 42 is coated with a thin layer of self-curing polymeric material, preferably urethane 54 such as Por-A-Mold S-2868 manufactured by Synair. These self-curing urethanes are hindered by water so that moisture left in the blanket material 42 will prevent adequate cure and adhesion. The coated blanket is then wrapped around the sleeve 44. The sieve 44 has a thickness ranging from 0.002 to 0.010, and preferably 0.005 inches thick. The continuous sleeve may be made of suitable expandable or stretchable metal, and preferably nickel. The sleeve and completed blanket should be expandable or stretchable as that is the usual manner in which they are installed on a blanket cylinder. That is, the sleeve is expanded or stretched with air pressure to permit it to be so installed.

Other bonding materials may be used but often require heat activation. Application of heat to the already cured flat blanket can degrade its physical properties.

Nickel sleeves 22 are preferred but any sleeve, made of a rigid or semi-rigid material and having a Youngs Moduus and thickness that allows it to be expanded sufficiently to slip over the printing cylinder during installation and removal while retracting to fit the outer diameter of the cylinder tightly during use, may be used. As noted, it is possible to use non-metallic materials for the sleeve in the present invention as the sleeve never need be exposed to high temperatures. The sleeve dimensions must be chosen so that the interference between the inside diameter of the sleeve and the outside diameter of the printing cylinder on which it will be mounted prevents slippage around the cylinder during use. For example, 0.005 inch thick nickel sleeve should have an inside diameter of 0.002 to 0.020 less than the outside diameter of the blanket cylinder on which it will be mounted.

The sleeve 22 is first treated and primed (see FIG. 5, numeral 58) in a manner common to the art and further coated with the self-curing urethane. The preferred primer is a single coat primer such as Pliogrip 6025, marketed by Ashland Chemical. Two coat primer systems may also be used.

The urethane or other coating is preferably applied to the back of the flat blanket by a doctor blade to completely fill the interstices of the fabric backing increasing the overall blanket thickness minimally or not at all. The urethane coating is applied to the sleeve by brushing but may also be applied by dipping, spreading with a doctor blade, spraying or other methods known to the art. The adhesive thickness may vary depending on the adhesive system used and should be consistent with the adhesive manufacturer's directions.

Hydrogenated nitrile rubber compounds have been successfully used in place of the urethane as solvated and spread adhesives or as calendered adhesive sheets. This method requires curing of the completed composite under pressure and at elevated temperatures while the urethane can be cured at room temperature. Of course, there are many other non-rigid adhesives that can be used to bond the blanket to the sleeve, such as acrylics or rubber based adhesives. They are only limited by the need for solvent and water resistance.

The ends 62 and 64 of the blanket are butted to each other such that the joint or seam 45 runs preferably parallel to the longitudinal axis of the sleeve. This butt joint should not be skewed by more than 1/16" to prevent misregistration (see discussion above), short print, walking, or unacceptable movement of the printed web.

While being manufactured, to hold the flat blanket material in place on the sleeve, it may be secured in place with clamps and spiral wrapped with mylar or other tape under controlled tension (2–10 lbs./in.), removing the clamps as the tape spiral traverses the length of the sleeve. The mylar or other tape is butt or spiral would in such a way that successive wraps overlap one another sufficiently (5 to 95%—preferably, 40 to 60%) to apply pressure to the entire surface of the blanket. Alternatively, the blanket may be secured with adhesive tape prior to wrapping with mylar and/or the entire blanket may be enclosed in a mold that simultaneously holds the blanket in position and applies the appropriate pressure. The self-curing urethane cures and bonds the flat blanket to the primed nickel sleeve within 24 hours at room temperature. This cure rate can be accelerated with exposure to elevated temperatures, so long as those temperatures do not degrade the product. 150° F. is a good curing temperature that would reduce the cure time to about 8 hours. The mylar tape or mold is then removed.

This invention includes the concept of using a manufacturing fixture or mold to improve the manufacturing quality of the blankets. The idea is to use a device such as a manufacturing fixture or a mold that would allow the seam to be located, aligned precisely, and securely held during the curing process. The fixture would also apply even pressure on the surface of the blanket after it has been wrapped around the tubular sleeve. This replaces the manual method of "wrapping" the blanket prior to curing the bonding agent. The result is that the blanket quality can be reproduced consistently. The skill level of the manufacturing person is not as critical. It will also lend to automating the entire manufacturing process in order to reduce the cost and increase the quality. For example, the mold or fixture would be generally "C" shaped in cross-section and closed by over center clamps that pull the mold or fixture closed. That is, the "C" closes upon itself to form an "O", with the blanket material sleeve in the center of the "O". After the material cures, the blanket sleeve is released from the mold and finished, as by grinding on its outer surface.

The remaining gap 45, if any, between the opposing ends of the blanket, can be filled with the urethane or nitrile material and allowed to cure adhering the two ends together and providing a suitable surface. The gap 45 should be filled with a resilient and solvent resistant compound to minimize gap bounce and to prevent water and solvents from wicking into the ends of the blanket. Of course, if the ends 62 and 64 are really a close fit or touching, then only sealing may be needed to prevent wicking, any such small or negligible gap not needing further filling.

It is also preferred that when used the gap filler material be of a different color from the blanket face so that the seam location is easily identified for proper alignment during installation. The same urethane is also utilized to seal the blanket materials 42 edges and prevent wicking into the sides of the blanket. The different color seam and a mark on the blanket cylinder could form part of an indexing system for properly locating the seam. Of course, another indicator than the seam could also be placed on the blanket cylinder and used with an appropriate mark on the blanket cylinder for indexing purposes.

Grinding to the appropriate diameter and surface roughness finishes the composite seamed cylindrical blanket. The diameter is specific to the press on which the sleeve will be used should be such that, in combination with the blanket's compressibility, excessive pressure does not cause slippage around the print cylinder. The appropriate surface roughness is achieved by selection of the face compound and grinding media. The "roughness average" (Ra) should be in the range of 0.2 to 2.0 microinches.

Prior art cylindrical blankets are typically built with a minimally thick composite covering the nickel sleeve. This results in excessive heat transfer to the cylinders on which they are mounted. During grinding, the heat transfer to the grinding mandrel can cause distortions requiring two stage or wet grinding. The blanket is first rough ground, allowed to cool and then finished. The thickness of the composite covering of this invention is such that heat transfer is negligible. Grinding may be accomplished in a single step and without the mess or capital expense associated with wet grinding.

According to this invention, multiple flat blanket pieces may be seamed together on a single sleeve for use on presses having multiple printing plates and thus multiple plate gaps. Such a blanket would have seams corresponding to the plate gaps and could be made to register with them. Also, according to the present invention any seam or seams on the sleeved blanket could be set up to fall in any corresponding area on the plate cylinder that did not interfere with useful printing.

The use of a mold to hold the flat blanket in position and apply pressure while the urethane cures allows for the possibility of using pre-ground or cast face blanket coverings. The impressions left by cure tapes/wraps require grinding of the finished sleeve, while the use of a mold leaves no such impressions. In this method, the gauge of the flat blanket material 42 covering and the outside diameter of the nickel sleeve control the outside diameter of the finished sleeve. Surface profiles are imparted in mass to the rolls of flat blanket material prior to cutting by methods well known to the art and reduce another unit by unit processing step.

The manufacturing costs associated with the prior art are high and the process is very slow. Output from the method of the present invention is three to four times higher than that of the prior art. And much of the auxiliary equipment such as blanket curing ovens, winding lathes, etc. are not needed. Production or purchasing of the blanket material covering in roll or flat form and large quantity significantly reduces the cost and individual seamed sleeves of the present invention can be completed at a rate of at least one every hour on the same machinery without the auxiliary equipment.

Unit to unit variations are common in the prior art. According to this invention, all seamed sleeves of the present invention produced from the same master roll of flat blanket material will be very consistent in properties.

In the prior art, there are no reinforcing or stabilizing threads in the horizontal direction. The threads applied in the circumferential direction are not parallel to the end plane of the sleeve. It is possible that this thread orientation is responsible for the tendency to draw in the paper web during use and the consequent side to side misregistration from printing unit to printing unit. The seamed cylindrical blanket of this invention provides threads both perpendicular and parallel to the axis of the sleeve and no such registration shift issues occur. The need for profiling the compressible layer is not necessary.

Prior art seamless, sleeved or cylindrical blankets have historically slipped fractionally around the printing cylinder during use which causes print distortion. The proper combination of the blanket compressibility and finished outside diameter of the secured sleeved blanket of the present invention has been found to eliminate this slippage.

In addition, sleeves may be used in the invention that are made of plastic, rubber, fiberglass, kevlar or other suitable materials having appropriate elasticity characteristics. Since our invention requires no final vulcanization process, sleeve materials with softening point less than 300° F. can now be considered for use. This was not possible with cylindrical blanket made by the prior art.

This invention also provides for a sleeve to blanket cylinder lock up system. The lock up system guarantees that once the blanket is installed if will not slip circumferentially or axially on the blanket cylinder. This movement has been a problem with prior art. For example, a notch or opening 80 could be provided in the sleeve which cooperates with a raised portion or pin 82 (indicated in dashed lines in FIG. 7) on the plate cylinder. Other suitable two part mechanisms or male and female portions that fit together could also be used, one in the sleeve with the other in the plate cylinder. Should a full locking system not be desired or needed, the sleeve and plate cylinder could be provided with appropriate indexing marks to locate the seam in the desired area, be it in the plate gap or other non-utilized non-printing area of the plate on the plate cylinder of the press.

While the preferred form of seamed, sleeved blanket and method of making and using the same of the present invention have been disclosed and described, it should be understood that other equivalent steps and elements of those called for in the below claims fall within the scope of the appended claims.

What is claimed is:

1. The combination of an improved seamed sleeved printing blanket with an offset lithographic printing press having a plate cylinder that has an axial, a radial, and a circumferential direction, said plate cylinder also having an outer circumferential surface, said outer circumferential surface of said plate cylinder being interrupted by a plate cylinder gap extending in a direction substantially parallel to the axial direction of said plate cylinder, with said plate cylinder gap having a plate cylinder gap width measured in the circumferential direction of said plate cylinder across said plate cylinder gap, and said printing press having a printing plate mounted substantially radially outwardly of said plate cylinder, said printing plate having a leading end, a trailing end, and two sides, said leading and trailing ends of said printing plate being tucked into said plate cylinder gap when said printing plate is mounted on said plate cylinder, said printing plate having an image-bearing surface that does not include said leading and trailing ends of said printing plate, said image-bearing surface of said printing plate being the radially outwardmost surface of said printing plate when said printing plate is mounted on said plate cylinder, said image-bearing surface being capable of bearing an inked image, and said printing press further having a blanket cylinder that has an axial, a radial, and a circumferential direction, said blanket cylinder having a continuous outer circumferential surface, wherein said improved seamed sleeved blanket comprises:

an expandable cylindrical sleeve, said cylindrical sleeve having an axial, a radial, and a circumferential direction, said cylindrical sleeve also having a continuous outer circumferential surface;

a sheet of pre-made blanket material having a leading edge, a trailing edge, and two side edges, said pre-made blanket material comprising multiple attached layers and being wrapped around the outer circumferential surface of said cylindrical sleeve, with said pre-made blanket material being adhered to the outer circumferential surface of said cylindrical sleeve such that both the leading edge and the trailing edge of said pre-made blanket material extend in a direction substantially parallel to the axial direction of said cylindrical sleeve, and wherein said leading edge and said trailing edge of said pre-made blanket material define a blanket gap;

wherein said blanket gap extends in a direction substantially parallel to the axial direction of said cylindrical sleeve;

wherein said pre-made blanket material adhered to said cylindrical sleeve has an axial, a radial, and a circumferential direction, as well as an outer circumferential surface, said outer circumferential surface of said pre-made blanket material being interrupted by said blanket gap;

wherein said blanket gap has a blanket gap width measured across said blanket gap in the circumferential direction of said pre-made blanket material adhered to said cylindrical sleeve;

wherein one layer of said multiple attached layers of said pre-made blanket material adhered to said cylindrical sleeve is a print layer, said print layer being the radially outwardmost layer of the multiple attached layers of said pre-made blanket material adhered to said cylindrical sleeve, said print layer having a printing surface located on the radially outwardmost surface of said print layer capable of receiving an inked image from said image-bearing surface of said printing plate and capable of transferring said inked image to a surface to be printed;

wherein another layer of said multiple attached layers of said pre-made blanket material adhered to said cylindrical sleeve is a volume compressible layer located radially inwardly of said print layer;

wherein said plate cylinder gap width is greater than or equal to said blanket gap width;

wherein said blanket contains filler material within said blanket gap to form a seam; and wherein said pre-made blanket material is adhered to said cylindrical sleeve using adhesive.

2. The combination of claim 1 wherein said seamed sleeved blanket is adapted to be located on said printing press such that neither said leading edge nor said trailing edge of said pre-made blanket material, nor said filler material, contact said printing surface of said printing plate.

3. The combination of claim 1 wherein said filler material fills substantially all of said blanket gap.

4. The combination of claim 3 wherein said filler material is a resilient material.

5. The combination of claim 3 wherein said filler material is a nitrile-based or urethane-based resilient material.

6. The combination of claim 1 wherein said filler material is a resilient material, fills substantially all of said blanket gap, is a different color than the printing surface of said pre-made blanket material adhered to said cylindrical sleeve, and extends radially outwardly approximately the same distance as the radially outwardmost dimension of the printing surface of the print layer of said pre-made blanket material adhered to said cylindrical sleeve.

7. The combination of claim 1 wherein said adhesive is capable of curing below vulcanizing temperature and below 300 degrees Fahrenheit.

8. The combination of claim 1 wherein said adhesive is a self-curing adhesive capable of curing and bonding the pre-made blanket to the cylindrical sleeve in 24 hours or less at room temperature.

9. The combination of claim 1 wherein said adhesive is a self-curing adhesive capable of curing and bonding the pre-made blanket material to the cylindrical sleeve in 8 hours or less at 150 degrees Fahrenheit.

10. The combination of claim 1 wherein said adhesive is a self-curing urethane adhesive.

11. The combination of claim 10 wherein said pre-made blanket material further comprises a supportive substrate being located radially inwardly of said volume compressible layer.

12. The combination of claim 1 wherein said cylindrical sleeve is made of metal.

13. The combination of claim 12 wherein said pre-made blanket material further comprises a supportive substrate being located radially inwardly of said volume compressible layer.

14. The combination of claim 1 wherein said cylindrical sleeve is made at least partially of nickel and has a thickness of 0.002 to 0.010 inches in the radial direction.

15. The combination of claim 14 wherein said pre-made blanket material further comprises a supportive substrate being located radially inwardly of said volume compressible layer.

16. The combination of claim 1 wherein said cylindrical sleeve is made of non-metallic material with one or more laminations or wrappings.

17. The combination of claim 16 wherein said cylindrical sleeve is made at least partially of polyethylene.

18. The combination of claim 1 wherein said seamed sleeved blanket can be elastically expanded in the radial direction of said cylindrical sleeve and placed onto said blanket cylinder of said printing press in the axial direction of said blanket cylinder.

19. The combination of claim 18 wherein said pre-made blanket material further comprises a supportive substrate being located radially inwardly of said volume compressible layer.

20. The combination of claim 1 wherein said pre-made blanket material further comprises a supportive substrate being located radially inwardly of said volume compressible layer.

* * * * *

UNITED STATES PATENT AND TRADEMARK OFFICE

CERTIFICATE OF CORRECTION

PATENT NO. : 7,131,375 B2
APPLICATION NO. : 11/186997
DATED : November 7, 2006
INVENTOR(S) : Joseph L. Byers et al.

It is certified that error appears in the above-identified patent and that said Letters Patent is hereby corrected as shown below:

Column 1,
Line 21: delete the number "5,553,674" and insert the number -- 5,535,674 --.

Column 2,
Line 49: delete the word "spring" and insert the word -- spreading --.

Line 60: delete the word "seamless" and insert the word -- seamed --.

Column 4,
Line 41: delete the word "coaxially" and insert the word -- commercially --.

Line 48: insert the word -- could -- between the word "sleeve" and the word "be".

Column 5,
Line 62: delete the word "sieve" and insert the word -- sleeve --.

Signed and Sealed this

Twenty-third Day of January, 2007

JON W. DUDAS
*Director of the United States Patent and Trademark Office*